US012565351B2

(12) United States Patent
Couture

(10) Patent No.: US 12,565,351 B2
(45) Date of Patent: Mar. 3, 2026

(54) CONVERTIBLE WRAP AROUND CONTAINER

(71) Applicant: WestRock Shared Services, LLC, Atlanta, GA (US)

(72) Inventor: David G. Couture, Hoschton, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 399 days.

(21) Appl. No.: 18/229,980

(22) Filed: Aug. 3, 2023

(65) Prior Publication Data

US 2024/0043162 A1 Feb. 8, 2024

Related U.S. Application Data

(60) Provisional application No. 63/395,414, filed on Aug. 5, 2022.

(51) Int. Cl.
*B65D 5/06* (2006.01)
*B65D 5/468* (2006.01)
*B65D 5/54* (2006.01)

(52) U.S. Cl.
CPC ..... *B65D 5/06* (2013.01); *B65D 5/4608* (2013.01); *B65D 5/541* (2013.01)

(58) Field of Classification Search
CPC ..... B65D 5/06; B65D 5/4608; B65D 5/541; B65D 5/5405; B65D 5/5445; B65D 5/542; B65D 2571/00524; B65D 2571/0066; B65D 2571/00728; B65D 2571/00574; B65D 5/16
USPC ..... 229/126, 242, 235, 117.13, 240, 925, 229/103, 241, 103.2, 117.12, 243; 206/774, 736, 746, 750, 738
See application file for complete search history.

(56) References Cited

U.S. PATENT DOCUMENTS

| | | | | |
|---|---|---|---|---|
| 2,547,892 | A * | 4/1951 | Stevens | B65D 5/16 229/242 |
| 4,946,042 | A * | 8/1990 | Ferreri | B65D 5/5405 229/242 |
| 6,402,021 | B1 * | 6/2002 | Heathcock | B65D 5/5445 229/242 |
| 6,729,475 | B2 * | 5/2004 | Yuhas | B65D 5/5495 229/120.08 |
| 8,070,052 | B2 | 12/2011 | Spivey, Sr. et al. | |
| 2012/0321754 | A1 | 12/2012 | Block | |

(Continued)

FOREIGN PATENT DOCUMENTS

| | | | |
|---|---|---|---|
| EP | 3301037 | A1 | 4/2018 |
| JP | 2006-062686 | A2 | 3/2006 |
| JP | 2010-159070 | A2 | 7/2010 |

*Primary Examiner* — Christopher R Demeree
(74) *Attorney, Agent, or Firm* — Neil G. Cohen; Rohini K. Garg

(57) ABSTRACT

A container includes a plurality of panels foldably connected to one another, wrapping around an interior space configured for containing product. Two of the plurality of panels cooperate to form a top wall of the interior space. A respective end flap is foldably connected to each of the two panels of the top wall. The end flaps cooperate to form a portion of an end wall that forms a lateral bound of the interior space. Each end flap is connected to its respective panel of the top wall with a line of weakness configured to be broken to allow conversion of the top wall wherein the two panels of the top wall are opened for access to the interior space.

20 Claims, 4 Drawing Sheets

(56) References Cited

U.S. PATENT DOCUMENTS

| | | | | |
|---|---|---|---|---|
| 2018/0305069 | A1* | 10/2018 | Keefe, Jr. ..... | B65D 5/5445 |
| 2022/0097903 | A1* | 3/2022 | Couture ..... | B65D 5/5445 |

* cited by examiner

CONVERTIBLE WRAP AROUND CONTAINER

CROSS REFERENCE TO RELATED APPLICATIONS

This application claims priority to U.S. Provisional Patent Application No. 63/395,414, filed Aug. 5, 2022. The entire contents of this application are incorporated herein in their entirety.

BACKGROUND

1. Field

The present disclosure relates to containers for containing product for shipping, storage, and the like, and more particularly to convertible containers.

2. Description of Related Art

A variety of conventional containers a used for containing product during shipping and storage. Some containers are convertible for use in a retail setting, to allow partial display of the product inside the container. For example, a container may contain multiple smaller packages of product during shipping and storage, which can be converted in the retail setting to display the smaller packages to customers in a retail aisle and allow them to retrieve individual packages of the product from the converted container.

The conventional techniques have been considered satisfactory for their intended purpose. However, there is an ever present need for improved systems and methods for convertible containers, including for other applications besides retail display. This disclosure provides a solution for this need.

SUMMARY

A container includes a plurality of panels foldably connected to one another, wrapping around an interior space configured for containing product. Two of the plurality of panels cooperate to form a top wall of the interior space. A respective end flap is foldably connected to each of the two panels of the top wall. The end flaps cooperate to form a portion of an end wall that forms a lateral bound of the interior space. Each end flap is connected to its respective panel of the top wall with a line of weakness configured to be broken to allow conversion of the top wall wherein the two panels of the top wall are opened for access to the interior space.

Each of the two panels of the top wall can define a handle portion therein. The handle portion of each of the two panels of the top wall can be configured to be converted to form a handle with the line of weakness of the end flaps broken to convert the container into a carrying case. Each handle portion can be defined by a line of weakness in the respective panel of the top wall.

The line of weakness of each end flap can be formed along a respective fold line connecting the flap to its respective panel of the top wall. The line of weakness of each end flap can include a microperforation line formed along the respective fold line. Each microperforation line can be sufficiently co-extensive with the respective fold line to allow for complete separation of each end flap from the respective panel of the top wall.

The plurality of panels can include a bottom panel. A first side panel can be foldably connected to the bottom panel along a fold line. A second side panel can be foldably connected to the bottom panel opposite from the first side panel along a fold line. A first top panel can be foldably connected to the first side panel by a fold line opposite from the bottom panel. The first top panel can be one of the two panels that forms the top wall. A second top panel can be foldably connected to the second side panel by a fold line opposite from the bottom panel. The second top panel can be one of the two panels that forms the top wall.

A first end flap can be foldably connected to a lateral edge of the first side panel. A second end flap can be foldably connected to a lateral edge of the second side panel. A third end flap can be foldably connected to a lateral edge of the bottom panel. A fourth end flap can be foldably connected to a first one of the two panels of the top wall. The fourth end flap can be a first one of the two respective end flaps foldably connected to the two panels of the top wall. A fifth end flap can be foldably connected to a second one of the two panels of the top wall. The fifth end flap can be a second one of the two respective end flaps foldably connected to the two panels of the top wall. The first end flap, the second end flap, the third end flap, the fourth end flap, and the fifth end flap can overlap and cooperate to form the end wall that forms a lateral bound of the interior space.

The end wall can be a first end wall, and there can be a second end wall forming a lateral bound of the interior space opposite the first end wall. A sixth end flap can be foldably connected to a lateral edge of the first side panel opposite from the first end flap. A seventh end flap can be foldably connected to a lateral edge of the second side panel opposite from the second end flap. An eighth end flap can be foldably connected to a lateral edge of the bottom panel opposite from the third end flap. A ninth end flap can be foldably connected along a line of weakness to the first one of the two panels of the top wall opposite from the fourth end flap. A tenth end flap can be foldably connected along a line of weakness to the second one of the two panels of the top wall opposite from the fifth end flap. The sixth end flap, the seventh end flap, the eight end flap, the ninth end flap, and the tenth end flap can overlap and cooperate to form the second end wall.

A blank for forming a container as described above is disclosed. The blank can include panels and flaps as those described above.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
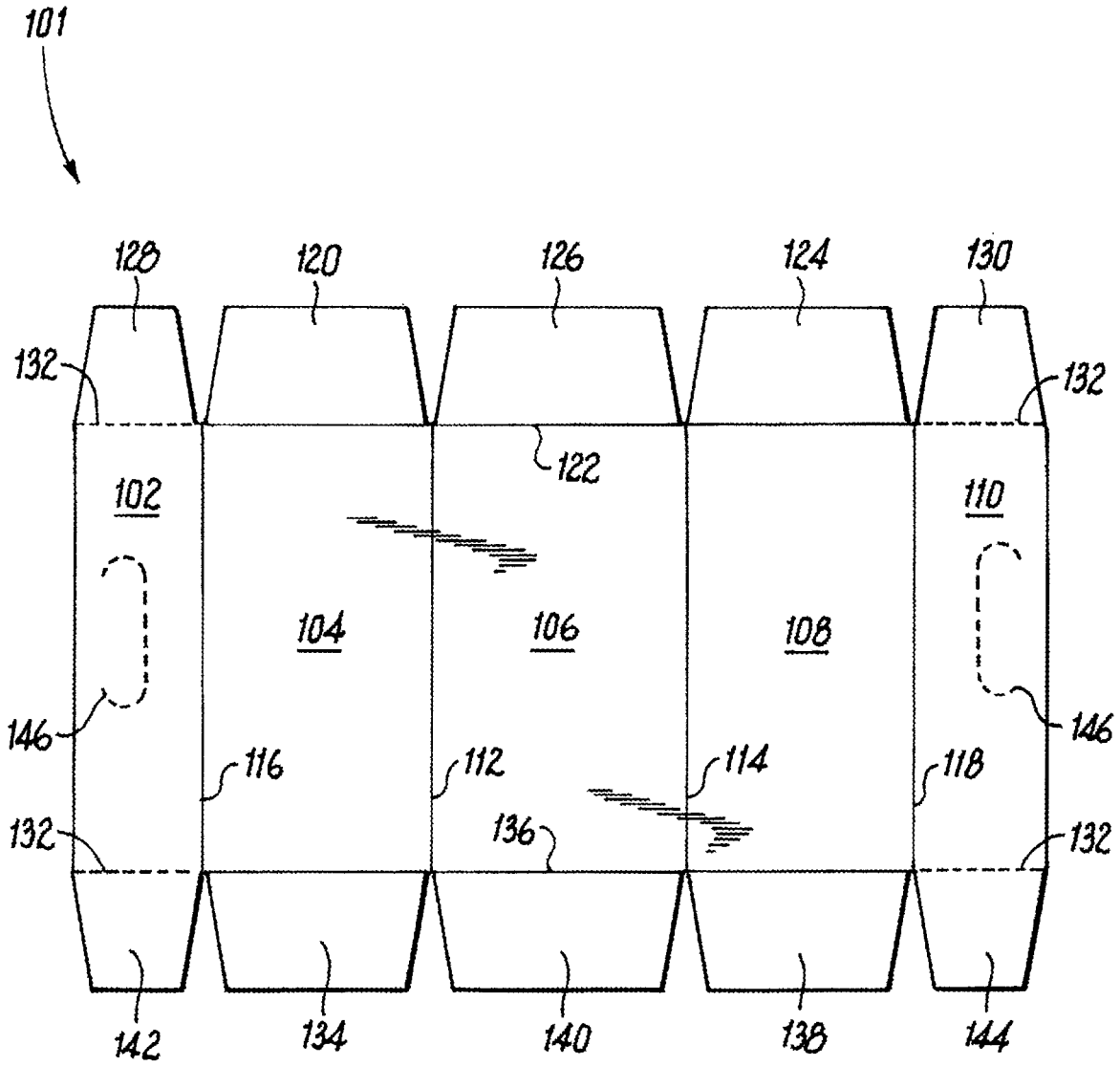
FIG. 1 is a schematic plan view of an embodiment of a blank for a container constructed in accordance with the present disclosure, showing the top panels with handle features and separable end flaps.
Figure 2:
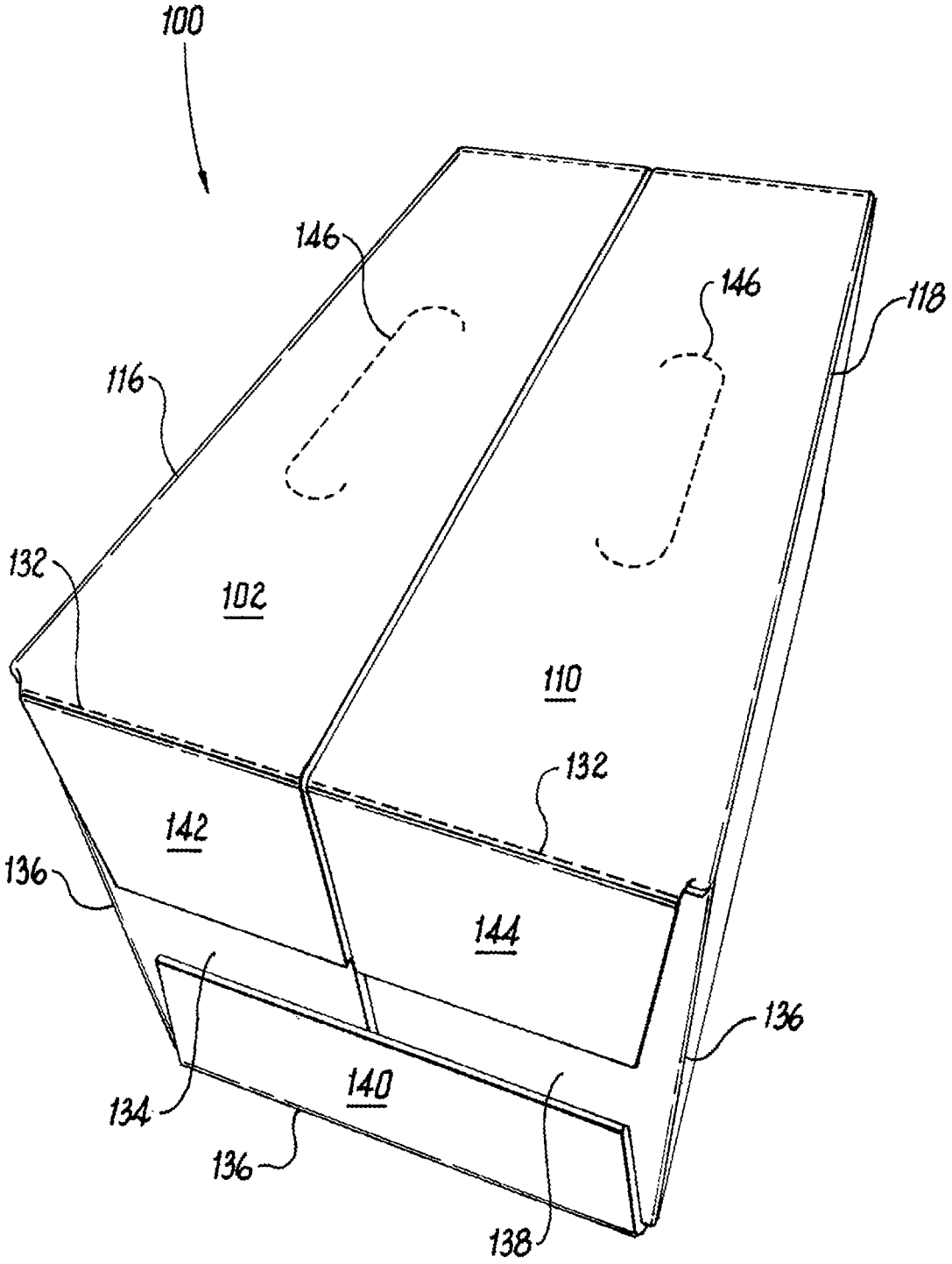
FIG. 2 is a perspective view of a container formed from the blank of FIG. 1, showing the top panels and end flaps prior to conversion of the container.

Reference will now be made to the drawings wherein like reference numerals identify similar structural features or aspects of the subject disclosure. For purposes of explanation and illustration, and not limitation, a view of an embodiment of a blank and corresponding container in accordance with the disclosure is shown in FIGS. 1 and 2, respectively, and is designated generally by reference characters 101 and 100. Other embodiments of systems in accordance with the disclosure, or aspects thereof, are provided in FIGS. 3-4, as will be described. The systems and methods described herein can be used to provide convertible containers, e.g. that can be used as a carrying case for product therein after the container is converted.

With reference first to FIG. 1, the blank 101 includes a plurality of panels 102, 104, 106, 108, 110 are foldably connected to one another along respective fold lines. The plurality of panels includes a bottom panel 106. A first side panel 104 is foldably connected to the bottom panel 106 along a fold line 112. A second side panel 108 is foldably connected to the bottom panel 106 along a fold line 114 opposite from the first side panel 104. A first top panel 102 is foldably connected to the first side panel 104 by a fold line 116 that is on the opposite side of the first side panel 104 from the bottom panel 106. A second top panel 110 is foldably connected to the second side panel 108 by a fold line 118 that is on an opposite side of the second side panel 108 from the bottom panel 106.

A first end flap 120 is foldably connected to a lateral edge of the first side panel 104 along the fold line 122. A second end flap 124 is foldably connected to a lateral edge of the second side panel 108 along the fold line 122. A third end flap 126 is foldably connected to a lateral edge of the bottom panel 106 along the fold line 122. A fourth end flap 128 is foldably connected to first top panel 102 along the fold line 122. The portion of the fold line 122 connecting between the fourth end flap 128 and the first top panel 102 includes a line of weakness 132, e.g. a perforation or microperforation. A fifth end flap 130 is foldably connected to the second top panel 110 along the fold line 122. The portion of the fold line 122 connecting between the fifth end flap 130 and the second tip panel includes a line of weakness 134 as described above for the fourth end flap 128.

A sixth end flap 134 is foldably connected along a fold line 136 to a lateral edge of the first side panel 104 opposite from the first end flap 120. A seventh end flap 138 is foldably connected to a lateral edge of the second side panel 108 opposite from the second end flap 124 along the fold line 136. An eighth end flap 140 is foldably connected to a lateral edge of the bottom panel 106 opposite from the third end flap 126 along the fold line 136. A ninth end flap 142 is foldably connected along a line of weakness 132 along the fold line 136, as described above with reference to the fourth end flap 128, to the first top panel 102 opposite from the fourth end flap 128. A tenth end flap 144 is foldably connected along a line of weakness 132 along the fold line 136, as described above with reference to the fourth end flap 128, to the second top panel 110 opposite from the fifth end flap 130.

Each of the two of the top panels 102, 110 defines a handle portion 146 therein. Each handle portion 146 is defined by a line of weakness, such as a perforation or the like, in the respective top panel 102, 110 in the shape of a C that opens toward the free edge 148 of the respective top panel 102, 110.

The container 100 of FIG. 2 can be formed from the blank 101 of FIG. 1 by wrapping the blank 101 around a mandrel or around product. Starting from the bottom panel 106, the first and second side panels 104, 108 can be folded upright on fold lines 112, 114 and the first and second top panels 102, 110 can be folded inward along the fold lines 116, 118 over the mandrel or product in the interior space 103 (labeled in FIG. 3). Then the end flaps 134 and 138 can be folded inward along fold line 136 to the position shown in FIG. 2. Finally, the end flaps 140, 142, 144 can be folded and adhered to the underlying end flaps 134, 138 to form a first end wall for a lateral bound of the interior space 103 (labeled in FIG. 3). Those skilled in the art will readily appreciate that the end flaps 120, 124, 126, 128, 130 can be folded and adhered in the same sequence to form the second end wall on the opposite end of the container 100 not shown in FIG. 2.

With continued reference to FIG. 2, the top panels 102 and 110 form the top wall of the container 100 opposite the bottom panel 106 (not shown in FIG. 2, but see FIG. 1), with the container wrapping around an interior space 103 (labeled in FIG. 3) for containing product. In this configuration, product can be shipped, stored, and the like, inside the container 100. The C-shape of the handle features 146 opens toward the center of the top wall as oriented in FIG. 2.

Figure 3:
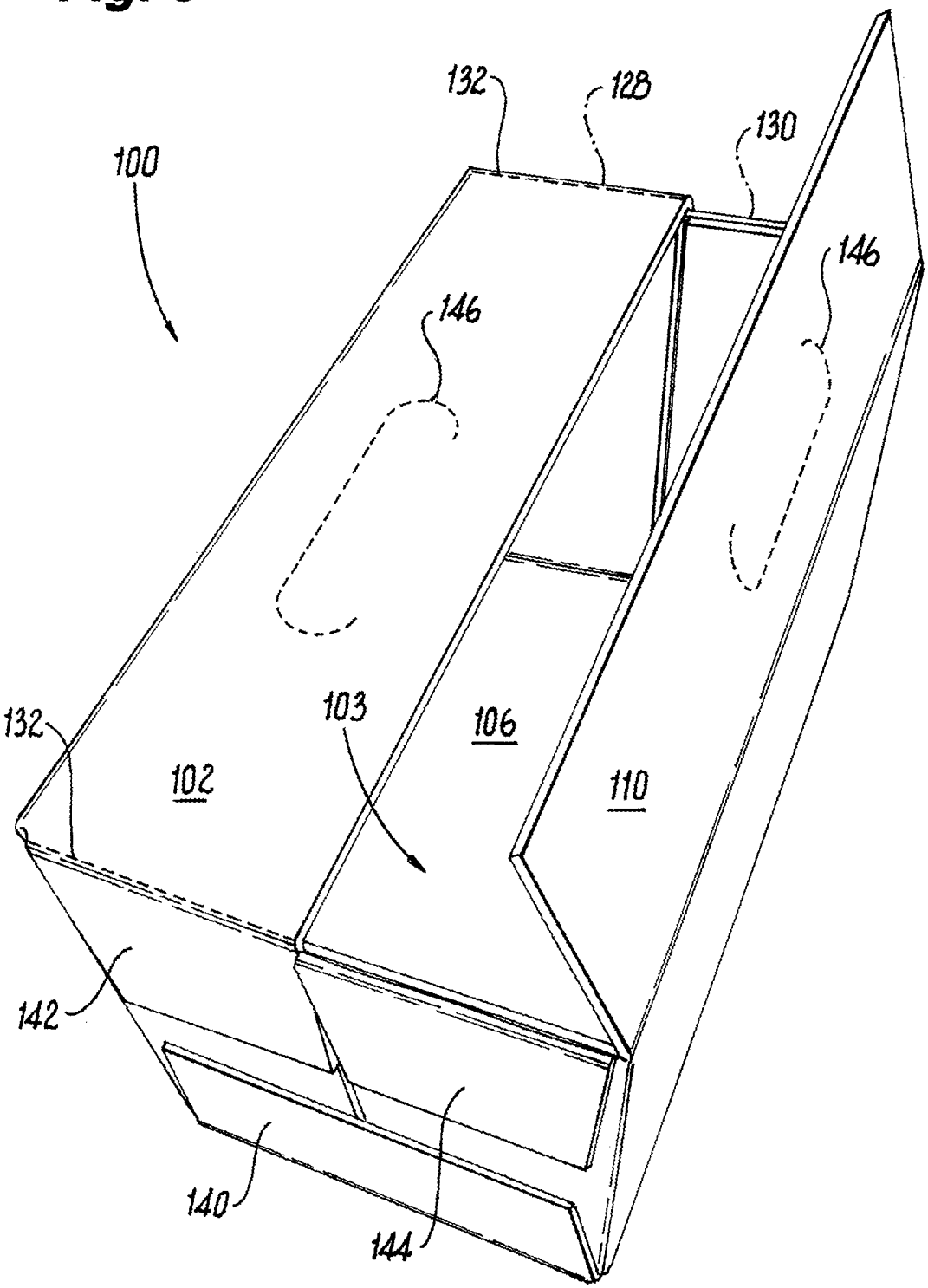
FIG. 3 is a perspective view of the container of FIG. 2, showing one of the top panels converted.

With reference now to FIG. 3, the container 100 can be converted, e.g. for use as a carrying case as follows. Since the end flaps 128, 130, 142, 144 is connected to their respective panels 102, 110 of the top wall with a line of weakness 132, the lines of weakness 132 can be broken to convert the top wall into a handle, and to are open the top walls 102, 110 for access to the interior space 103. Each line of weakness 132, e.g. microperforation line, is sufficiently co-extensive with the respective fold line 122 (labeled in FIG. 1) to allow for complete separation of each end flap 128, 130, 142, 144 from the respective panel 102, 110 of the top wall.

Figure 4:
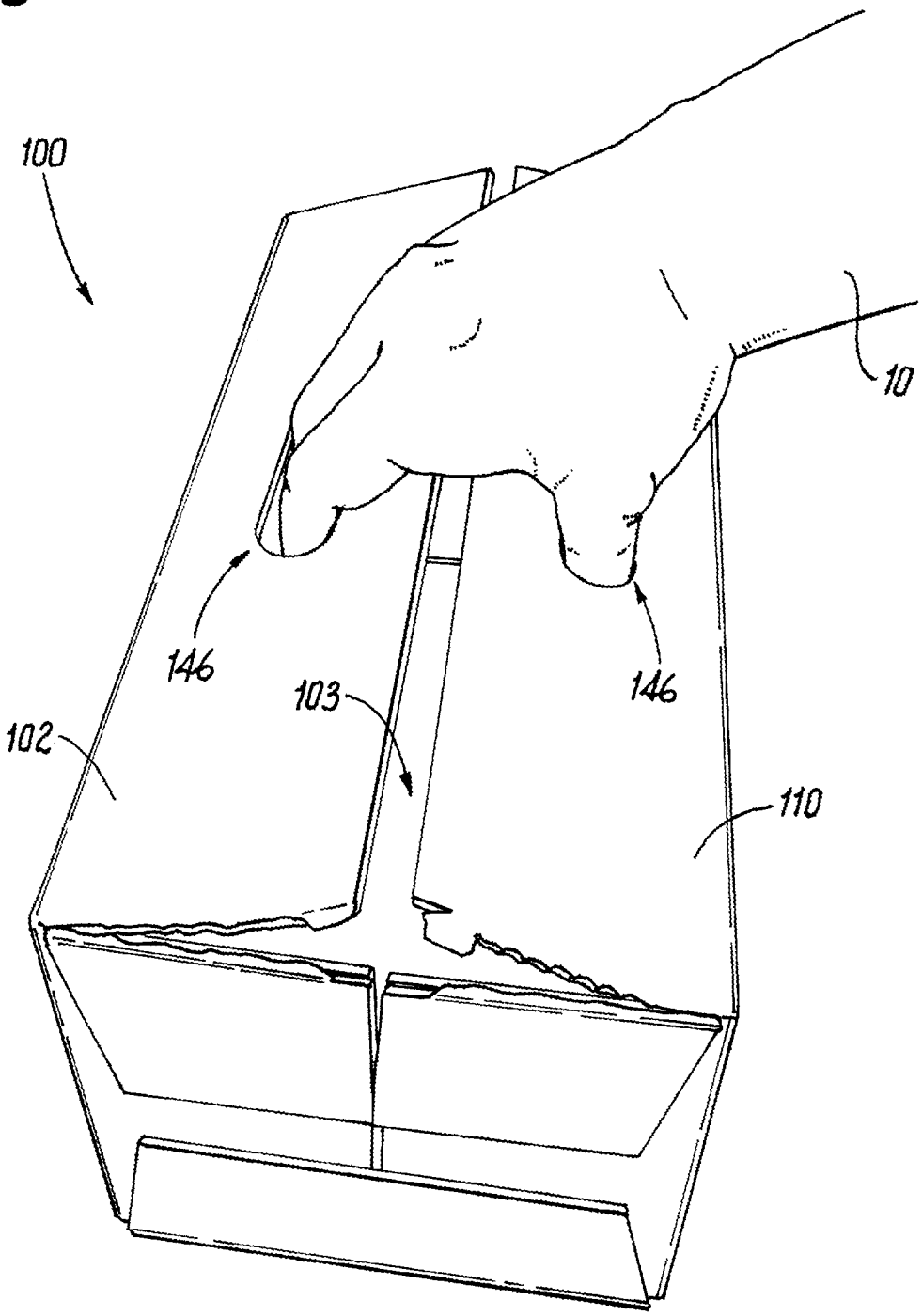
FIG. 4 is a perspective view of the container of FIG. 2, showing how the handle features can be handled after conversion of the two top panels, e.g., to utilize the container as a carrying case for product therein.

In FIG. 3, the top panel 110 is shown converted, and in FIG. 4, both of the top panels 102, 110 are converted. This includes conversion of the handle features 146 by breaking the C-shaped lines of weakness for use as a handle as shown by the user 10 grasping the handle features 146 in FIG. 4, e.g. to use the container 100 as a carrying case.

The methods and systems of the present disclosure, as described above and shown in the drawings, provide for convertible containers, e.g. that can be used as a carrying case for product therein after the container is converted. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A container comprising:

a plurality of panels foldably connected to one another, wrapping around an interior space configured for containing product, wherein two of the plurality of panels cooperate to form a top wall of the interior space; and a respective end flap foldably connected to each of the two panels of the top wall, wherein the end flaps cooperate to form a portion of an end wall that forms a lateral bound of the interior space, wherein each end flap is connected to its respective panel of the top wall with a line of weakness configured to be broken to allow conversion of the top wall wherein the two panels of the top wall are opened for access to the interior space.

2. The container as recited in claim 1, wherein each of the two panels of the top wall defines a handle portion therein, wherein the handle portion of each of the two panels of the top wall is configured to be converted to form a handle with the line of weakness of the end flaps broken to convert the container into a carrying case.

3. The container as recited in claim 2, wherein each handle portion is defined by a line of weakness in the respective panel of the top wall.

4. The container as recited in claim 1, wherein the line of weakness of each end flap is formed along a respective fold line connecting the flap to its respective panel of the top wall.

5. The container as recited in claim 4, wherein the line of weakness of each end flap includes a microperforation line formed along the respective fold line.

6. The container as recited in claim 5, wherein each microperforation line is sufficiently co-extensive with the respective fold line to allow for complete separation of each end flap from the respective panel of the top wall.

7. The container as recited in claim 1, wherein the plurality of panels includes:

a bottom panel;

a first side panel foldably connected to the bottom panel along a fold line;

a second side panel foldably connected to the bottom panel opposite from the first side panel along a fold line;

a first top panel foldably connected to the first side panel by a fold line opposite from the bottom panel, wherein the first top panel is one of the two panels that forms the top wall; and a second top panel foldably connected to the second side panel by a fold line opposite from the bottom panel, wherein the second top panel is one of the two panels that forms the top wall.

8. The container as recited in claim 7, further comprising:

a first end flap foldably connected to a lateral edge of the first side panel;

a second end flap foldably connected to a lateral edge of the second side panel;

a third end flap foldably connected to a lateral edge of the bottom panel;

a fourth end flap foldably connected to a first one of the two panels of the top wall, wherein the fourth end flap is a first one of the two respective end flaps foldably connected to the two panels of the top wall; and a fifth end flap foldably connected to a second one of the two panels of the top wall, wherein the fifth end flap is a second one of the two respective end flaps foldably connected to the two panels of the top wall, wherein the first end flap, the second end flap, the third end flap, the fourth end flap, and the fifth end flap overlap and cooperate to form the end wall that forms a lateral bound of the interior space.

9. The container as recited in claim 8, wherein the end wall is a first end wall, wherein there is a second end wall forming a lateral bound of the interior space opposite the first end wall.

10. The container as recited in claim 9, further comprising:

a sixth end flap foldably connected to a lateral edge of the first side panel opposite from the first end flap;

a seventh end flap foldably connected to a lateral edge of the second side panel opposite from the second end flap;

an eighth end flap foldably connected to a lateral edge of the bottom panel opposite from the third end flap;

a ninth end flap foldably connected along a line of weakness to the first one of the two panels of the top wall opposite from the fourth end flap; and a tenth end flap foldably connected along a line of weakness to the second one of the two panels of the top wall opposite from the fifth end flap, wherein the sixth end flap, the seventh end flap, the eight end flap, the ninth end flap, and the tenth end flap overlap and cooperate to form the second end wall.

11. A blank for forming a container comprising:

a plurality of panels foldably connected to one another, configured to wrap around an interior space for containing product, wherein two of the plurality of panels are configured to cooperate to form a top wall of the interior space; and a respective end flap foldably connected to each of the two panels of the top wall, wherein the end flaps are configured to cooperate to form a portion of an end wall that forms a lateral bound of the interior space, wherein each end flap is connected to its respective panel of the top wall with a line of weakness configured to be broken to allow conversion of the top wall wherein the two panels of the top wall are opened for access to the interior space.

12. The blank as recited in claim 11, wherein each of the two panels of the top wall defines a handle portion therein, wherein the handle portion of each of the two panels of the top wall is configured to be converted to form a handle with the line of weakness of the end flaps broken to convert the container into a carrying case.

13. The blank as recited in claim 12, wherein each handle portion is defined by a line of weakness in the respective panel of the top wall.

14. The blank as recited in claim 11, wherein the line of weakness of each end flap is formed along a respective fold line connecting the flap to its respective panel of the top wall.

15. The blank as recited in claim 14, wherein the line of weakness of each end flap includes a microperforation line formed along the respective fold line.

16. The blank as recited in claim 15, wherein each microperforation line is sufficiently co-extensive with the respective fold line to allow for complete separation of each end flap from the respective panel of the top wall.

17. The blank as recited in claim 11, wherein the plurality of panels includes:

a bottom panel;

a first side panel foldably connected to the bottom panel along a fold line;

a second side panel foldably connected to the bottom panel opposite from the first side panel along a fold line;

a first top panel foldably connected to the first side panel by a fold line opposite from the bottom panel, wherein the first top panel is one of the two panels that is configured to form the top wall; and a second top panel foldably connected to the second side panel by a fold line opposite from the bottom panel, wherein the second top panel is one of the two panels configured to form the top wall.

18. The blank as recited in claim 17, further comprising:

a first end flap foldably connected to a lateral edge of the first side panel;

a second end flap foldably connected to a lateral edge of the second side panel;

a third end flap foldably connected to a lateral edge of the bottom panel;

a fourth end flap foldably connected to a first one of the two panels of the top wall, wherein the fourth end flap is a first one of the two respective end flaps foldably connected to the two panels of the top wall; and a fifth end flap foldably connected to a second one of the two panels of the top wall, wherein the fifth end flap is a second one of the two respective end flaps foldably connected to the two panels of the top wall, wherein the first end flap, the second end flap, the third end flap, the fourth end flap, and the fifth end flap are configured to overlap and cooperate to form the end wall to form a lateral bound of the interior space.

19. The blank as recited in claim 18, wherein the end wall is a first end wall, wherein there is a plurality of flaps configured to form a second end wall as a lateral bound of the interior space opposite the first end wall.

20. The blank as recited in claim 19, wherein the plurality of flaps configured to form the second end wall includes:

a sixth end flap foldably connected to a lateral edge of the first side panel opposite from the first end flap;

a seventh end flap foldably connected to a lateral edge of the second side panel opposite from the second end flap;

an eighth end flap foldably connected to a lateral edge of the bottom panel opposite from the third end flap;

a ninth end flap foldably connected along a line of weakness to the first one of the two panels of the top wall opposite from the fourth end flap; and a tenth end flap foldably connected along a line of weakness to the second one of the two panels of the top wall opposite from the fifth end flap, wherein the sixth end flap, the seventh end flap, the eight end flap, the ninth end flap, and the tenth end flap are configured to overlap and cooperate to form the second end wall.

* * * * *